US011117338B2

(12) United States Patent
Beer

(10) Patent No.: US 11,117,338 B2
(45) Date of Patent: Sep. 14, 2021

(54) WASTE MATERIAL COMPACTOR

(71) Applicant: Easyquip Pty Ltd, Hazelwood North (AU)

(72) Inventor: Gregory Robert Beer, Hazelwood North (AU)

(73) Assignee: Easyquip Pty Ltd.

( * ) Notice: Subject to any disclaimer, the term of this patent is extended or adjusted under 35 U.S.C. 154(b) by 373 days.

(21) Appl. No.: 16/154,868

(22) Filed: Oct. 9, 2018

(65) Prior Publication Data

US 2019/0344521 A1 Nov. 14, 2019

Related U.S. Application Data

(60) Provisional application No. 62/739,433, filed on Oct. 1, 2018.

(30) Foreign Application Priority Data

May 11, 2018 (AU) ..... 2018203317

(51) Int. Cl.
*B30B 3/02* (2006.01)
*B30B 15/30* (2006.01)

(52) U.S. Cl.
CPC ..... *B30B 3/02* (2013.01); *B30B 15/30* (2013.01)

(58) Field of Classification Search
CPC ..... B30B 9/3064; B30B 9/121; B30B 9/128; B30B 9/14; B30B 9/16; B30B 11/24; B30B 11/245; B30B 11/246; B30B 3/005; B30B 3/02; B30B 3/04; B30B 3/045; B30B 3/06; B30B 15/308; B02C 19/22; B04B 2001/205; B01F 7/086; B01F 2015/0011
USPC ..... 366/323; 494/54
See application file for complete search history.

(56) References Cited

U.S. PATENT DOCUMENTS 750,668 A * 1/1904 Liedbeck ..... B04B 1/20 494/53
2,703,676 A * 3/1955 Gooch ..... B04B 1/20 494/42
3,424,375 A * 1/1969 Fritz ..... B04B 1/20 494/4
5,108,040 A * 4/1992 Koenig ..... B30B 11/246 241/260.1
2015/0375942 A1* 12/2015 Mellander ..... D21C 7/06 198/617
2016/0280459 A1* 9/2016 Fillion ..... B30B 11/246
2017/0312658 A1* 11/2017 Bradt ..... B30B 9/12

* cited by examiner

*Primary Examiner* — Teresa M Ekiert
*Assistant Examiner* — Sarkis A Aktavoukian

(57) ABSTRACT

A waste material compaction device includes an auger cone having a base skirt; a hopper for containing said auger cone; a support located inside the auger cone and fitted to the hopper; an auger flight arranged on an outer surface of the auger cone; a first bearing located adjacent the base skirt of the auger cone; a second bearing positioned inside the auger cone at a distance from the first bearing; and an electric motor and a gearbox for driving the auger cone and the auger flight such that waste material placed in the hopper is compacted in a predetermined direction; the first and second bearings bearing a working load of the waste material compaction device.

19 Claims, 7 Drawing Sheets

WASTE MATERIAL COMPACTOR

PRIORITY INFORMATION

The present application claims priority, under 35 U.S.C. § 119(e), from U.S. Provisional Patent Application, Ser. No. 62/739,433, filed on Oct. 1, 2018. The entire content of U.S. Provisional Patent Application, Ser. No. 62/739,433, filed on Oct. 1, 2018, is hereby incorporated by reference.

The present application claims priority, under 35 U.S.C. § 119(a), and claims the benefit of earlier filing date and right of priority to Australian Patent Application No. 2018203317, filed on May 11, 2018. The entire content of Australian Patent Application No. 2018203317 is hereby incorporated by reference.

BACKGROUND

There are many types of waste compaction devices in use and these include the paddle pendulum packer that has a large flat blade that pivots and moves in an arc through a pair of arms connected at the pivot point. The blade moves in one direction and as debris and refuse is entered into the container it moves in the other direction to compact the refuse either into the same container or another container by using the other side of the flat blade.

There also exist blade packers which use hydraulic cylinders whereby a blade is forced to move in one direction, using the cylinders to compact waste material and then retract in the opposite direction. This is typically used at the back of rubbish trucks and the like. The existing blade packers are used extensively in a fixed compactor and receiver configuration. These types of compactors are not suitable for wet waste material and are prone to material bypassing the blade and building up behind the blade or falling to the ground.

There exists a screw compactor whereby when waste falls on the screw, the screw pushes the waste in a particular direction. The screw compactor has an auger comprising a central core with a flight on the outside of that core for pushing the waste material in a particular direction. The screw compactor generally has a parallel shaft and the auger flight or helix around the outside of the central core is also mostly parallel.

One of the problems with the screw compactor of existing designs is that they generally get bound up with plastic material, and more particularly, with shrink wrap plastic material which results in the machine jamming.

Some designs of this type of compactor are also prone to leakage from wet waste material. Furthermore, there is a long overhang of the central core beyond the bearings which bear the brunt of the forces that arise through the operation of the auger. This puts a very large strain on the bearings and can impact on the life of the bearings and the auger itself.

Furthermore, existing screw compactors have a complex arrangement of driving mechanisms whereby a motor and a gearbox are generally placed outside of the auger. Some mechanisms use sprockets and chains which are subject to wear and need constant maintenance.

Therefore, it is desirable to overcome one or more of the abovementioned problems by providing a waste material compactor which is simpler in mechanical design and compactness.

BRIEF DESCRIPTION OF THE DRAWINGS

The drawings are only for purposes of illustrating various embodiments and are not to be construed as limiting, wherein.

DETAILED DESCRIPTION OF THE PREFERRED EMBODIMENT

Figure 1:
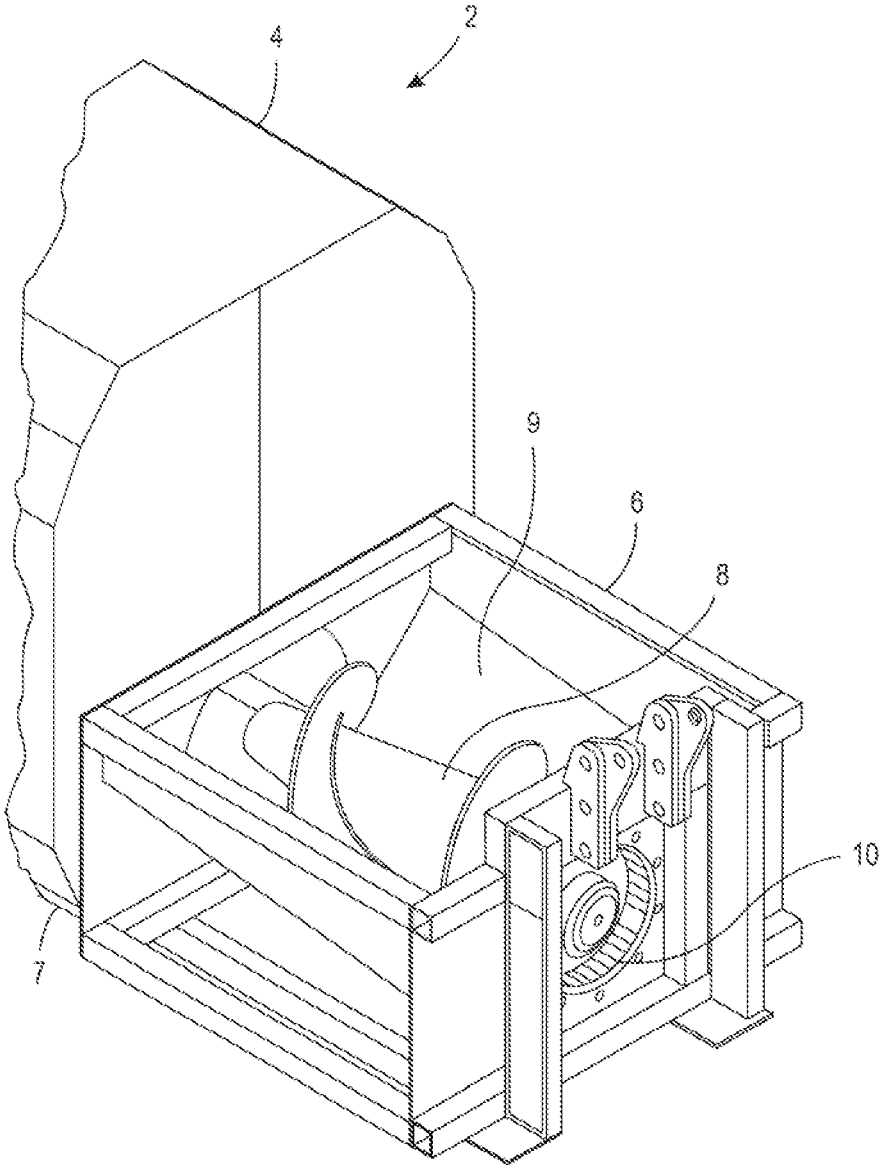
FIG. 1 is a perspective view from above of a hopper and receiver showing a compaction device located in the hopper.
Figure 2:
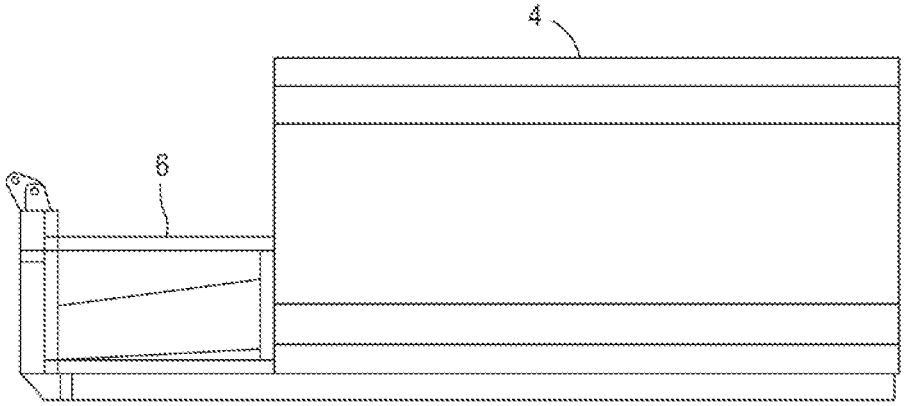
FIG. 2 is a side view of the hopper and receiver in FIG. 1.
Figure 3:
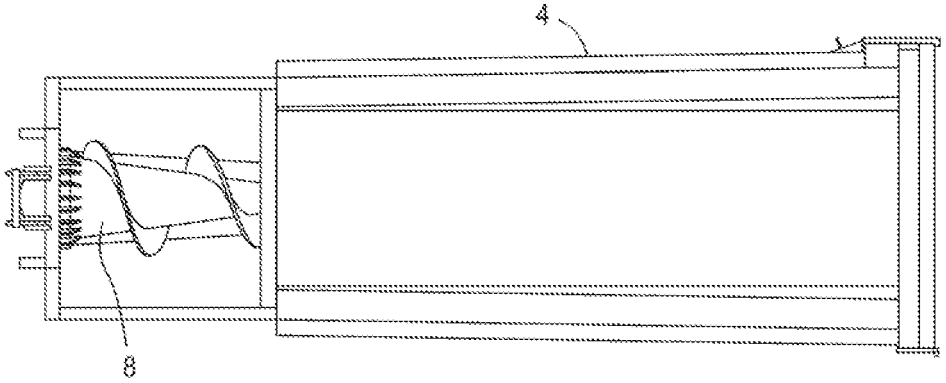
FIG. 3 is a plan view of the hopper and receiver of FIG. 1 showing the auger of the compaction device.

Referring to FIGS. 1, 2, and 3 there is shown a storage device 2 that includes a first container, called a receiver 4 and a second container, called a hopper 6. The hopper has an open top into which debris or waste material is loaded and this is assisted by an angled plate 9 located on either inner side of the hopper 6. Located inside the hopper 6 and attached or connected to end face (front mounting panel) 10 is a waste compaction device 8. It includes a tapering auger cone 12, which has attached to its outer surface a continuously tapering auger flight or blade 14 (as seen side on) which is helix-shaped.

The auger cone 12 tapers from the end 16 to a smaller output end 18 which is adjacent a large aperture 7 in one end of the receiver 4 where it joins with the hopper 6. It therefore has no tip and is termed frusto-conical or a truncated cone. Any waste material is emptied into the hopper 6 as described previously and the device 8 is powered by an electric motor and a gearbox in order to drive or rotate the auger cone so as to move and compress the waste material, that is entered into the hopper 6, into and through the aperture 7 to eventually be compacted within the inside of the receiver 4.

Figure 4:
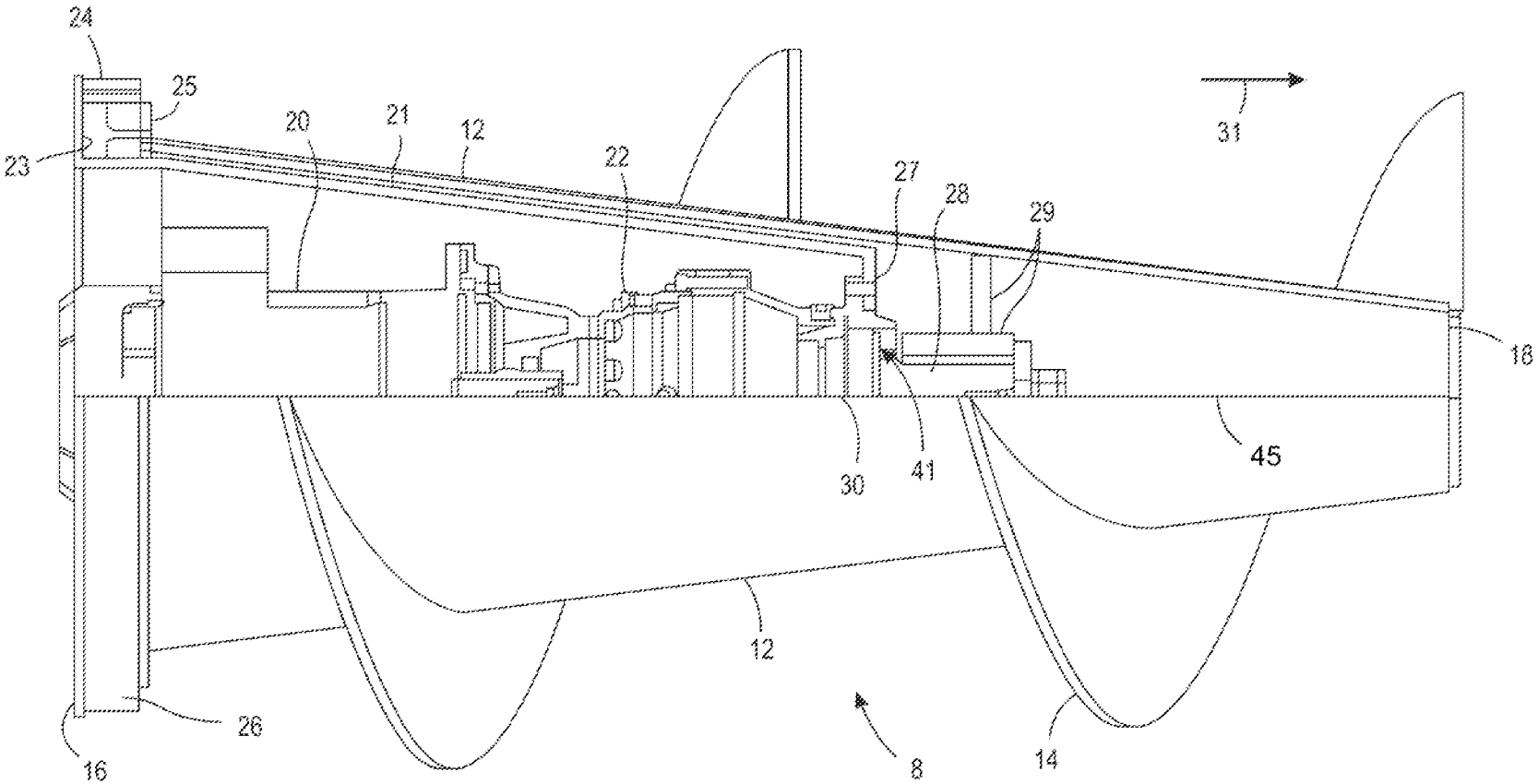
FIG. 4 is a side view partly showing the interior of the compaction device with a motor and gear box located therein.

Referring to FIGS. 4, 4A, 5A, 5B, and 6, a support means, in the form of a mounting cone 21 in this embodiment, is located inside the auger cone 12 (outlined in red in FIG. 4). The mounting cone is also truncated or frusto-conical in shape. The support means may alternatively be a structure that fits to or is integral with end 16. The auger cone 12 is secured, preferably by welding, to an auger drive boss 29. The auger drive boss 29 is mounted to an output shaft 28 of a gearbox 22, which in the form of a planetary gearbox 22, that is attached to electric motor 20. The motor and gearbox assembly, called a gearmotor, is mounted or bolted to the mounting cone 21 through mount 27 so that the motor 20 and gearbox 22 is, in this embodiment, fully located within the mounting cone 21 and completely sealed.

This is different to prior art devices which generally have the gear box and motor outside of the auger cone 12. Alternatively, the motor 20 and gearbox 22, or the motor 20 itself, can be located outside the auger cone 12, such that a longer drive shaft or output shaft (supported by a support means in the form of flanges or gussets) extends from gearbox 22 along a substantial length inside the auger cone 12. As an example, the gearbox 22 can be supported by mounts inside the auger cone 12 (such as the mounting cone 21) while the motor 20 is located outside the auger cone 12 either in-line or at an angle through a worm or bevel gear arrangement. The mounting cone 21 is attached to the front panel or end 10 of the hopper 6, through base ring 24 of the mounting cone 21 so that the device 8 is completely sealed.

Figure 4A:
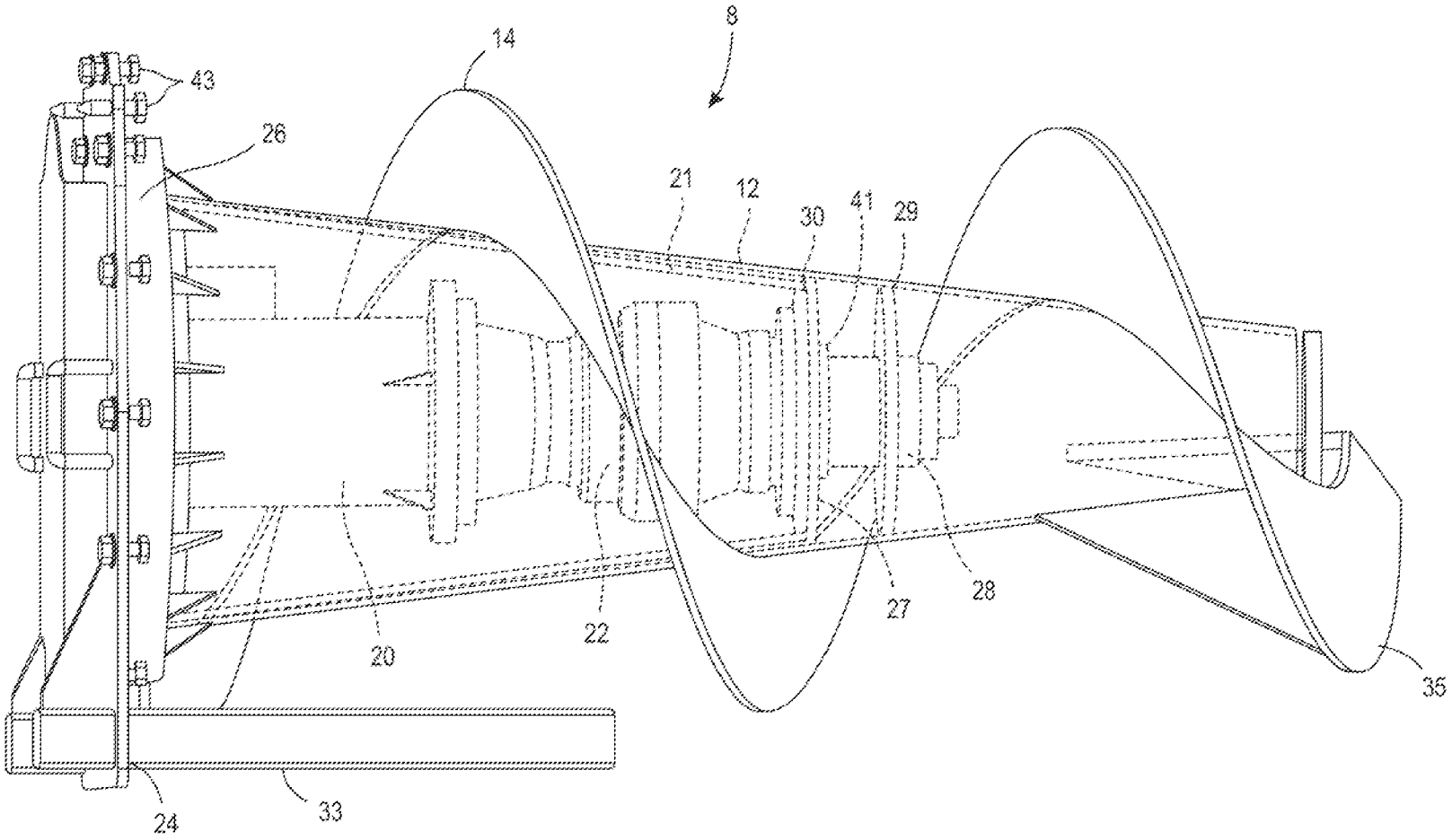
FIG. 4A is a further side view partially transparent to show interior components of the compaction device.
Figure 5A:
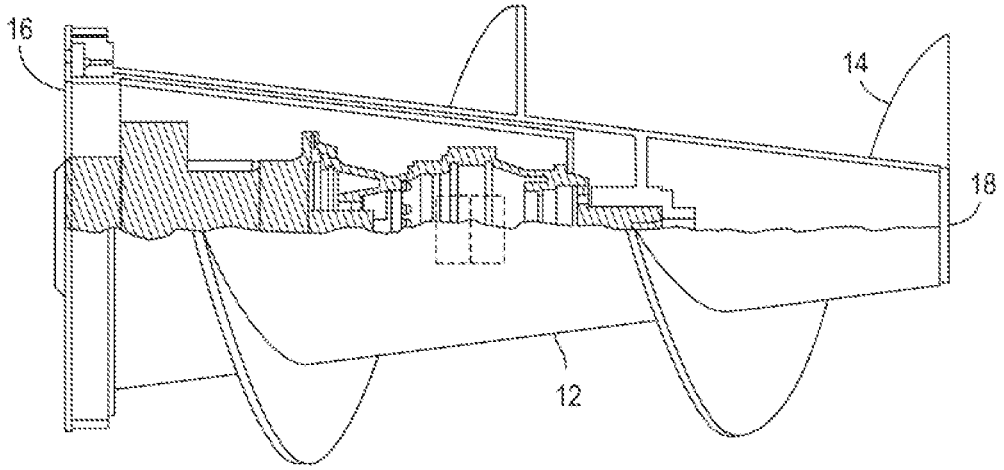
FIGS. 5A and 5B are respectively full and part side sectional views of the compaction device showing internal components.
Figure 5B:
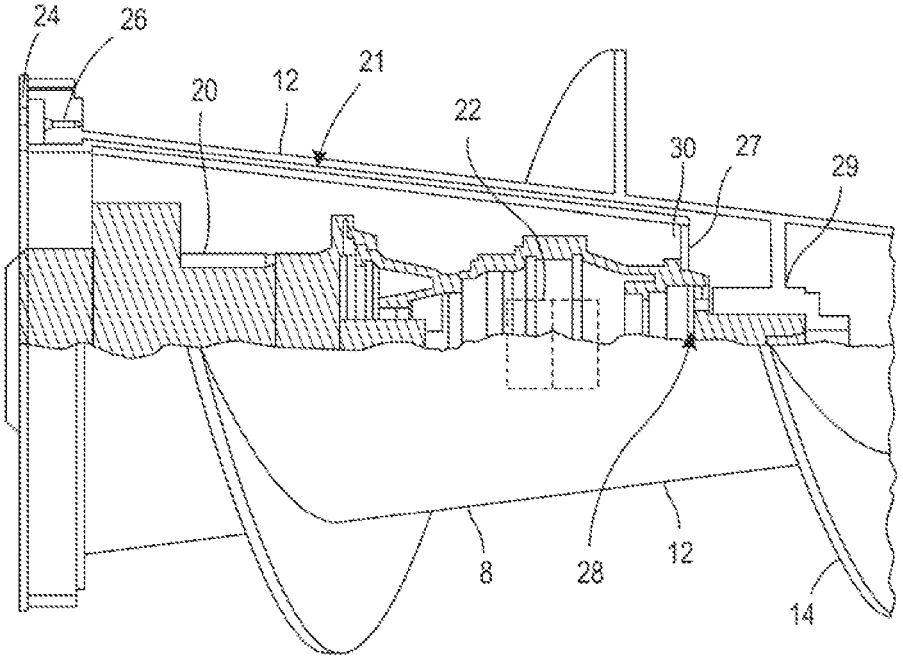
Figure 6:
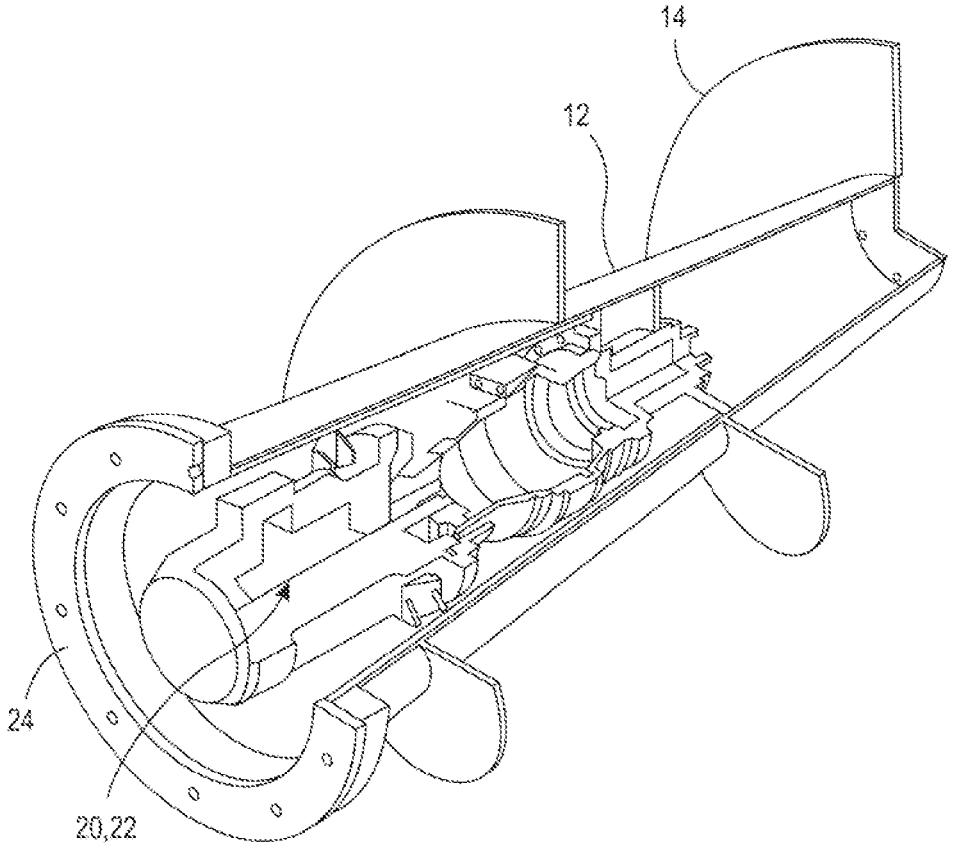
FIG. 6 is a rear perspective sectional view showing the interior components of a mounting cone of the compaction device.

As seen in FIG. 4A, a series of nuts and bolts 43 are located around the periphery of the ring 24 to enable attachment to the end 10 of the hopper 6. A first bearing 26, called a radial thrust bearing made preferably from Teflon, is located near to end 16 of the device 8, adjacent to mounting cone base ring 24 and is fixed to the base skirt 25 of the outer, auger cone 12 and bears against a machined surface 23 at the base of mounting cone 21, that is, at the mounting cone base ring 24 (see FIG. 4). The first bearing 26 may be free standing without attachment to another component, such that it is supported by the mounting cone base ring 24 and the auger cone base skirt 25. The inside of the mounting cone 21 is open to the air.

The motor 20 is connected to a control panel through a motor cable which protrudes through end 16 and exits from the motor 20 terminal box from inside the mounting cone 21. Thus there is no requirement for sealing at this location. The output shaft 28 to the planetary drive gearbox 22 is located adjacent a second bearing 30, which is a high capacity axial thrust and radial load roller bearing and is located significantly or substantially inside the cone 12 at about two-thirds of the length of the auger cone 12, along its central axis 45, measured from end 16 of the device 8. The mounting cone base ring 24 is welded or bolted to the inside surface of the end 10 of the hopper 6.

The working loads of the device are borne by both of bearings 26 and 30, and with a distance separating these two bearings 26 and 30, any forces that are placed upon the device 8 or forces that are generated by the device 8, reduce the load on the bearings system. When power is provided to the electric motor 20, it rotates the auger cone 12 in a first direction, at a speed determined by the gearbox 22, to force debris and waste material, such as paper, timber, plastics and plastic wrapping in the direction of arrow 31 into receiver 4. The flight 14 drives against the waste material forcing it into aperture 7 of receiver 4. The direction of rotation of the flight 14 and cone 12 can be reversed via the control panel. Conveniently, a pair of tubes 33, at the lower part of the base ring 24, enables tines of a forklift to be located. An output shaft seal 41 prevents any ingress of dirt or moisture to the gearbox 22.

The whole system is a completely sealed system and is essentially maintenance free for the life of the machine. The full depth of the hopper and cone are water tight that renders the machine suitable for wet or moist material to be compacted. Also the tapering flight diameter and the tapering auger cone facilitate the non-binding of any stringy waste such as pallet wrappings and banding. This is a common problem with previous prior art machines.

The specific dimensions of the auger cone 12 are an internal diameter of 522 mm and an external diameter of 730 mm at end 16. At end 18, the auger cone 12 has a diameter of about 200 mm. The overall length of the device 8 is about 1500 mm, the tapered angle of the auger cone 12 is between 1 and 10 degrees and preferably about 7 degrees (which is also the taper on the mounting cone 21 inside the auger cone 12) and the tapered angle of the auger flight 14, with respect to the central axis 45, is about 1 to 10 degrees, but preferably about 4 degrees.

Figure 7:
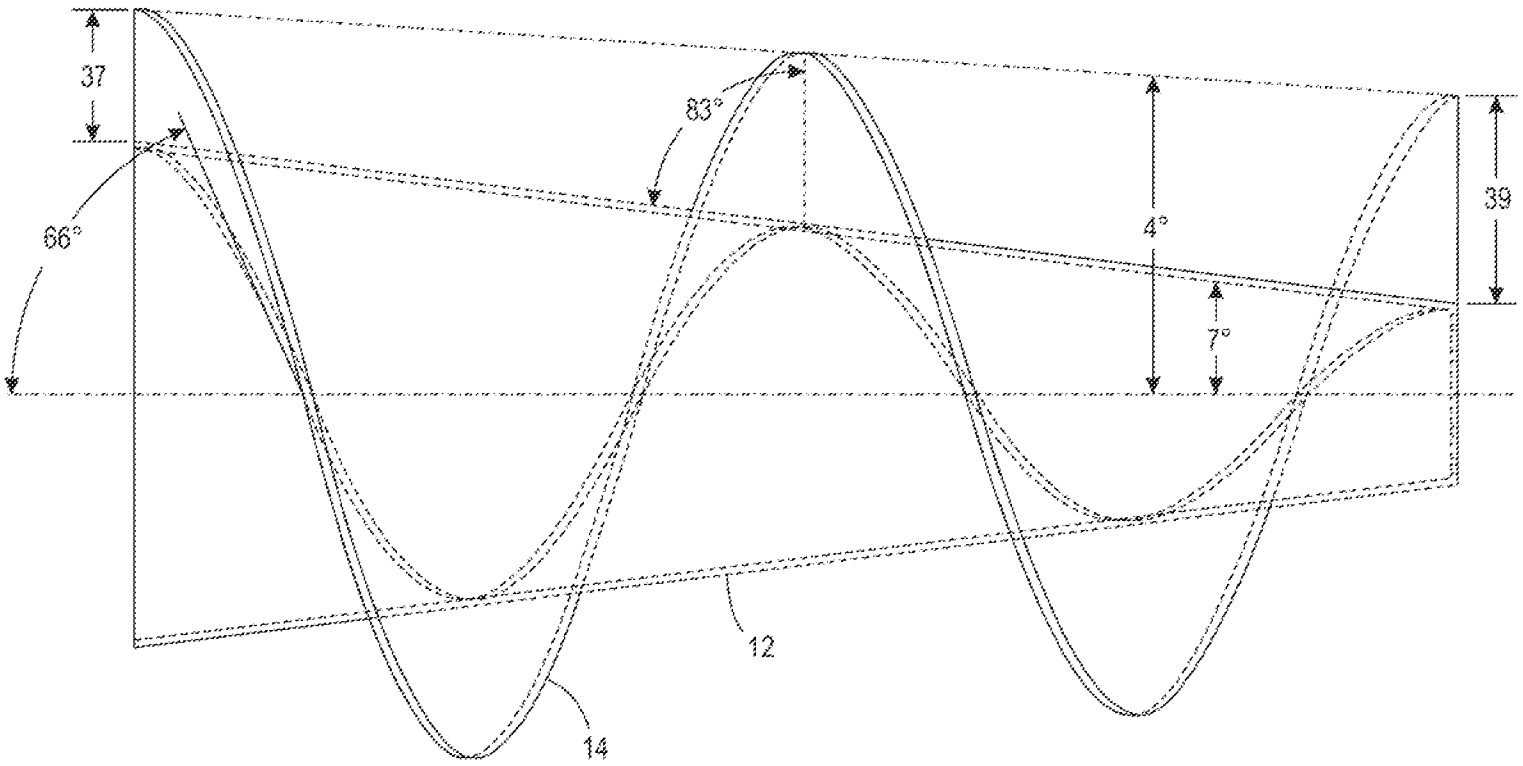
FIG. 7 is a perspective view of part of the exterior of the device showing the angle of the auger cone and associated flight.

As the auger cone 12 and flight 14 rotate, the divergent angles between the auger cone 12 and the auger flight 14, for example 7 degrees for the cone 12 and 4 degrees for the flight 14, enables wet material and stringy waste material like wrapping and banding to be easily forced, rapidly and non-bindingly, to the end of the hopper 6 and into the receiver 8. The depth of the auger flight 14 varies along the length of the auger cone 12, from about 150 mm at 37 to about 200 mm at 39 in FIG. 7, as a result of the divergent angles of the tapers of the cone 12 and flight 14.

A plate 35 located at the end of the auger flight 14 assists in compacting the waste material and preventing it from returning to the hopper through aperture 7. The auger cone 12, the mounting cone 21 and the flight 14 are made from mild steel or stainless steel.

In summary, a waste material compaction device compacts waste material from a container, such as a hopper, into a further larger container, called a receiver.

A waste material compaction device includes an auger cone; a support means located inside the auger cone and fitted to a container; an auger flight arranged on an outer surface of the auger cone; a first bearing means located adjacent the connection of a base skirt of the auger cone and a second bearing means positioned significantly inside the auger cone; an electric motor and a gearbox for providing drive to the auger cone and auger flight such that waste material placed in the container is compacted in a predetermined direction.

A first bearing means may bear against a surface of a base ring of the support means, the base ring attached to an end face of the container.

The second bearing means may be located inside the auger cone at about two-thirds the overall length of the auger cone away from the auger cone base skirt.

The support means may be a mounting cone.

The container may be a hopper.

The auger cone may be tapered with respect to a central axis of the auger cone, the tapered auger cone preventing the waste material binding and jamming within the container.

The range of angle of the taper of the auger cone with respect to the central axis of the cone may be from 1 to 10 degrees.

The auger flight may be tapered at a divergent angle to the taper of the auger cone, the divergence between the auger flight and the auger cone assisting the compaction of the waste material into a receiver from the container.

The range of angle of the taper of the auger flight with respect to the central axis of the cone may be from 1 to 10 degrees.

The central axis of the auger cone may align with the centre of the end face of the container at the base skirt of the auger cone, and with an aperture in the wall of a receiver, into which the waste material is forced by movement of the auger cone and flight, at an opposite truncated end of the auger cone.

It will be appreciated that several of the above-disclosed embodiments and other features and functions, or alternatives thereof, may be desirably combined into many other different systems or applications. Also, various presently unforeseen or unanticipated alternatives, modifications, variations, or improvements therein may be subsequently made by those skilled in the art which are also intended to be encompassed by the description above and the following claims.

What is claimed is:

1. A waste material compaction device comprising:

an auger cone having a base skirt;

a hopper for containing said auger cone;

a support located inside aid auger cone and fitted to said hopper;

an auger flight arranged on an outer surface of said auger cone;

a first bearing located adjacent said base skirt of said auger cone;

a second bearing positioned inside said auger cone at a distance from said first bearing; and an electric motor and a gearbox for driving said auger cone and said auger flight such that waste material placed in said hopper is compacted in a predetermined direction;

said first and second bearings bearing a working load of the waste material compaction device.

2. The waste material compaction device according to claim 1, wherein said second bearing is located inside said auger cone at two-thirds of an overall length of said auger cone away from said base skirt of said auger cone.

3. The waste material compaction device according to claim 2, wherein said support is a mounting cone.

4. The waste material compaction device according to claim 3, wherein said auger cone has a taper with respect to a central axis of said auger cone, said taper of said auger cone preventing the waste material binding and jamming within said hopper.

5. The waste material compaction device according to claim 2, wherein said auger cone has a taper with respect to a central axis of said auger cone, said taper of said auger cone preventing the waste material binding and jamming within said hopper.

6. The waste material compaction device according to claim 1, wherein said support is a mounting cone.

7. The waste material compaction device according to claim 6, wherein said auger cone has a taper with respect to a central axis of said auger cone, said taper of said auger cone preventing the waste material binding and jamming within said hopper.

8. The waste material compaction device according to claim 1, wherein said auger cone has a taper with respect to a central axis of said auger cone, said taper of said auger cone preventing the waste material binding and jamming within said hopper.

9. The waste material compaction device according to claim 8, wherein said taper of said auger cone, with respect to said central axis of said auger cone is in a range from 1 to 10 degrees.

10. The waste material compaction device according to claim 9, further comprising:

a receiver;

said auger flight having a taper at a divergent angle to said taper of said auger cone, the divergence between said auger flight and said auger cone assisting the compaction of the waste material being placed into said hopper and assisting the driving of the waste material in said predetermined direction into said receiver;

said receiver being separate from said hopper.

11. The waste material compaction device according to claim 10, wherein said central axis of said auger cone aligns with a center of an end face of said hopper at said base skirt of said auger cone; and aligns with an aperture in a wall of said receiver.

12. The waste material compaction device according to claim 8, further comprising:

a receiver;

said auger flight having a taper at a divergent angle to said taper of said auger cone, the divergence between said auger flight and said auger cone assisting the compaction of the waste material being placed into said hopper and assisting the driving of the waste material in said predetermined direction into said receiver;

said receiver being separate from said hopper.

13. The waste material compaction device according to claim 12, wherein said central axis of said auger cone aligns with a center of an end face of said hopper at said base skirt of said auger cone and aligns with an aperture in a wall of said receiver.

14. The waste material compaction device according to claim 1, wherein said support is configured to conform to a shape of said auger cone.

15. The waste material compaction device according to claim 1, wherein said gearbox includes an outward shaft, said outward shaft being located adjacent to said second bearing.

16. The waste material compaction device according to claim 1, wherein said gearbox is located within said support.

17. The waste material compaction device according to claim 1, wherein said support is a mounting cone.

18. The waste material compaction device according to claim 17, wherein said mounting cone has a truncated shape.

19. The waste material compaction device according to claim 17, wherein said mounting cone has a frusto-conical shape.

* * * * *